US008590806B2

(12) United States Patent
Drechsel

(10) Patent No.: US 8,590,806 B2
(45) Date of Patent: Nov. 26, 2013

(54) LIQUID DIFFUSER DEVICE

(76) Inventor: Arno Drechsel, Lienz (AT)

( * ) Notice: Subject to any disclaimer, the term of this patent is extended or adjusted under 35 U.S.C. 154(b) by 348 days.

(21) Appl. No.: 13/054,080

(22) PCT Filed: Jul. 24, 2009

(86) PCT No.: PCT/IB2009/053222

§ 371 (c)(1),
(2), (4) Date: Feb. 1, 2011

(87) PCT Pub. No.: WO2010/010534

PCT Pub. Date: Jan. 28, 2010

(65) Prior Publication Data

US 2011/0114751 A1 May 19, 2011

(30) Foreign Application Priority Data

Jul. 24, 2008 (IT) ..... VI2008A0175

(51) Int. Cl.

| | |
|---|---|
| ***B05B 3/04*** | (2006.01) |
| ***B05B 3/02*** | (2006.01) |
| ***F23D 11/04*** | (2006.01) |

(52) U.S. Cl.
USPC ..... 239/222.17; 239/222; 239/214

(58) Field of Classification Search
USPC ..... 239/214, 222.11, 222.17, 222.21, 498, 239/499, 505, 507, 512, 513, 518; 403/122–144; 384/609–615
See application file for complete search history.

(56) References Cited

U.S. PATENT DOCUMENTS

| | | | | |
|---|---|---|---|---|
| 3,853,362 | A * | 12/1974 | Howland et al. | 384/604 |
| 4,905,577 | A * | 3/1990 | Schneeweiss | 92/158 |
| 5,439,174 | A * | 8/1995 | Sweet | 239/222.17 |
| 5,588,595 | A * | 12/1996 | Sweet et al. | 239/222.17 |
| 5,762,269 | A | 6/1998 | Sweet | |
| 6,254,013 | B1 * | 7/2001 | Clearman et al. | 239/222.11 |
| 6,267,299 | B1 * | 7/2001 | Meyer | 239/222.17 |
| 6,360,965 | B1 * | 3/2002 | Clearman et al. | 239/222.19 |
| 6,457,865 | B1 * | 10/2002 | Masciarelli, Jr. | 384/49 |
| 6,932,279 | B2 * | 8/2005 | Burcham | 239/222.17 |

FOREIGN PATENT DOCUMENTS

| | | |
|---|---|---|
| EP | 0743098 | 11/1996 |
| GB | 1343337 | 1/1974 |
| WO | 0156702 | 8/2001 |

* cited by examiner

*Primary Examiner* — Len Tran
*Assistant Examiner* — Alexander M Valvis
(74) *Attorney, Agent, or Firm* — Themis Law

(57) ABSTRACT

A liquid diffuser device, comprising a support frame (2) with an upper passageway (3) to direct a liquid jet and a lower hollow tubular body (4) with a bottom wall (5), a liquid jet deflecting member (9) having an upper plate (10) fixed to a lower stem (11) which is had within the tubular body (4), means (13) for movably coupling the stem (11) to the bottom wall (5), comprising at least one lower contact surface (14) of the stem (11) and at least one upper contact surface (15) of the bottom wall (5). The movable coupling means (13) comprise an intermediate contact member (16) secured to the lower end portion (12) of the stem (11), and continuously contacting the upper surface (15) of the bottom wall (5) to avoid downward shifting of the stem (11) consequent to wear of the contact surfaces (14, 15).

4 Claims, 2 Drawing Sheets

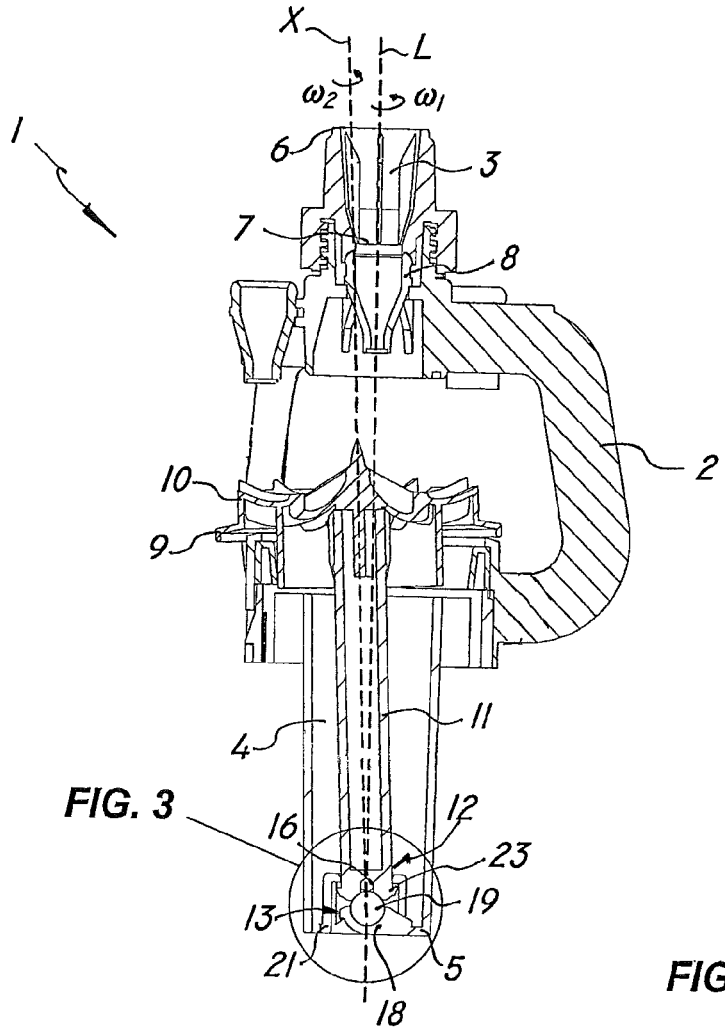
FIG. 3
FIG. 2
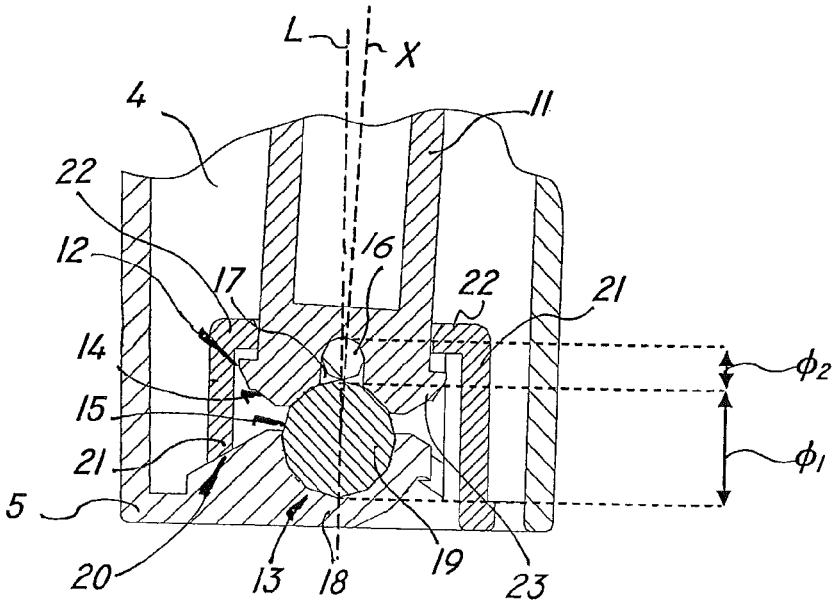
FIG. 3

LIQUID DIFFUSER DEVICE

FIELD OF THE INVENTION

The present invention generally finds application in the field of irrigation systems for agricultural and industrial applications, and particularly relates to a liquid diffuser device.

BACKGROUND ART

Liquid diffuser devices as used in irrigation systems for delivery of water or other liquids, commonly known as "sprinklers", comprise a support frame which is designed to be connected to the hydraulic system and has a nozzle for directing the liquid jet to a specially shaped diffusion plate.

The latter is in turn mounted to a deflecting member, having a rotating stem of such a size as to move, under jet pressure, with a combined motion of rotation about its own central axis and rotation or precession about the jet-defined axis, for uniform peripheral deflection of the jet.

In certain prior art solutions, as described for instance in U.S. Pat. No. 5,950,927 and U.S. Pat. No. 6,176,440, the stem has a lower portion formed with a conical or spheroidal rolling surface, which is designed to roll on a rolling track, also of conical or spheroidal shape, formed in the lower part of the frame.

These solutions have the apparent drawback of not allowing constant coupling of the surface and the rolling track, which results in a high risk of the jet being unevenly deflected.

Furthermore, the normal operating pressures exerted by the jet on the deflector body cause deformations of the two contact surfaces, resulting in an efficiency loss.

U.S. Pat. No. 5,439,174 discloses a device in which the stem and the frame are coupled by a CV joint which locks the stem, and hence the hole deflector body, in the axial direction, while allowing it to rotate and oscillate.

The joint is composed of a spherical element integral with the lower end of the stem and housed in a concavity formed in the lower part of the frame, within which the spherical element can rotate.

However, also in this case, normal operating pressures may cause deformation of the spherical element and, as a result, a downward shift, even though to a little extent, of the deflector body.

Thus, the distance of the plate from the nozzle will be longer than the optimal device calibration distance, and the jet will not be optimally deflected.

U.S. Pat. No. 5,588,595 discloses another deflector device similar to the one described above, in which the spherical element is locked in a roller cage containing a plurality of coplanar spaced ball bearings.

The spherical element is placed at the center and simultaneously contacts all the rollers to allow stem oscillations.

However, also in this case, the deformations of the various spherical components, caused by jet pressure, may cause a change of the initial orientation of the device, resulting in an inefficient operation thereof.

Furthermore, the roller cage is greatly susceptible to the building up of foreign matter, i.e. dust and sand, with a high risk of irregular operation, which might also lead to total blockage.

DISCLOSURE OF THE INVENTION

The object of this invention is to overcome the above drawbacks, by providing a diffuser device that has a simple and efficient construction and is relatively cost-effective.

Another object of the present invention is to provide a diffuser device that allows a constant distance to be maintained between the deflecting plate and the jet delivery nozzle, thereby ensuring optimal device operation, even after long use.

A further object is to provide a diffuser device that is protected from ingress of foreign matter, to withstand particularly dusty and contaminating environments and have a regular operation therein.

These and other objects, as more clearly explained hereafter, are fulfilled by a liquid diffuser device as defined in claim 1, which comprises a support frame with an upper passageway to direct a liquid jet and a lower hollow tubular body defining a first longitudinal axis and having a substantially transverse bottom wall, a liquid jet deflecting member having an upper deflecting plate located at a predetermined distance from the passageway and fixed to a lower stem defining a second longitudinal axis, said stem being held within said tubular body, means for movably coupling the stem to said bottom wall, comprising at least one lower contact surface of said stem and at least one upper contact surface of said bottom wall, to allow rotation of said stem relative to said bottom wall and oscillation of said second axis about said first axis, responsive to the action of the liquid jet on said plate.

The invention is characterized in that the movable coupling means comprise an intermediate contact member secured to the lower end portion of said stem and continuously contacting said upper contact surface of said bottom wall.

Thus, the intermediate member will prevent even the slightest downward shift of the stem, and hence of the plate secured thereto, consequent to wear of the contact surface, thereby keeping the distance of the plate from the passageway substantially unchanged with time.

BRIEF DESCRIPTION OF THE DRAWINGS

Further features and advantages of the invention will be more apparent from the detailed description of a preferred, non-exclusive embodiment of a diffuser device of the invention, which is described as a non-limiting example with the help of the annexed drawings, in which:

FIG. 2 is a cross sectional view of the device of FIG. 1;

FIG. 3 is an enlarged perspective view of a detail of FIG. 2;

DETAILED DESCRIPTION OF A PREFERRED EMBODIMENT

Figure 1:
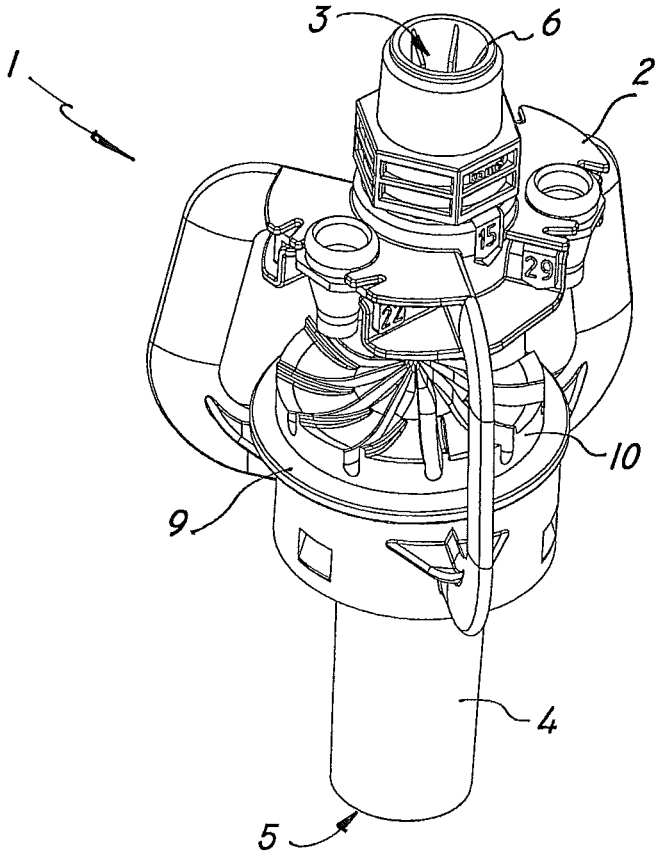
FIG. 1 is a perspective view of a liquid diffuser device of the invention.
Figure 4:
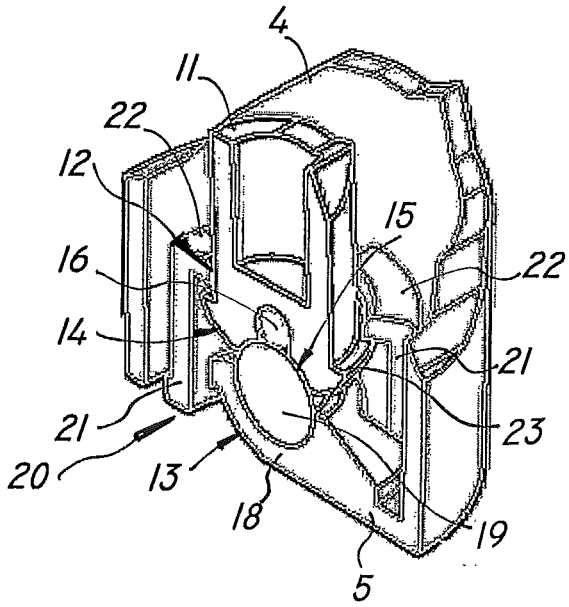
FIG. 4 is a side view of the detail of FIG. 3.

Referring to the above figures, the diffuser device of the invention, generally designated by numeral 1, may be used to distribute a liquid, e.g. water, over surfaces, possibly having a very large surface area, such as in the irrigation of agricultural areas.

The device may be connected to a hydraulic system, not shown, for liquid delivery and may be mounted, alone or in combination with other similar devices, to a stationary or rotating support arm, also not shown, to be set at a predetermined height, according to the desired jet length.

According to the invention, a liquid diffuser device comprises a support frame 2 having an upper passageway 3 to direct a liquid jet in a predetermined direction and a lower hollow tubular body 4 defining a first longitudinal axis L and having a substantially transverse bottom wall 5.

The frame 2 may be connected to the irrigation system at the inlet 6 of the upper tubular passageway 3 and be equipped, at the outlet 7, with a fixed or removable nozzle 8 for directing the liquid jet in a predetermined direction.

Preferably, the tubular passageway 3 may be coaxial with the lower tubular body 4 for axial jet delivery.

Nevertheless, the passageway 3 and/or the nozzle 8 that can be associated therewith, may be also placed in off-center positions, according to arrangements known in the art.

The device 1 further includes a liquid jet deflecting member 9 having an upper deflecting plate 10 located at a predetermined distance from the passageway 3 and secured to a lower stem 11 that is held in the tubular body 4 and has a lower end portion 12 defining a second longitudinal axis X.

Means 13 are further provided for movably coupling the stem 11 to the bottom wall 5 of the tubular body 4.

The movable coupling means 14 have a lower contact surface 14 of the stem 11 and an upper contact surface 15 of the bottom wall 5, that are suitably shaped to allow rotary motion of the stem 11 relative to the bottom wall 5.

Furthermore, the contact surfaces 14, 15 are appropriately configured to allow oscillation of the second axis X about the first axis L responsive to the action of the liquid jet on the deflecting element 9.

According to a peculiar characteristic of the invention, the movable coupling means 13 comprise an intermediate contact member 16 secured to the lower end portion 12 of the stem 11 and continuously contacting the upper contact surface 15 of the bottom wall 5.

The intermediate element 16 has the purpose of preventing any downward shift of the stem 11 consequent to the wear of one or both contact surfaces 14, 15, which might result from continuous use of the device 1.

Thus, the distance of the plate 10 from the outlet 7 of the tubular passageway 3 will remain substantially constant even after long use of the device 1, for optimal operation thereof.

In the preferred, non exclusive configuration of the present invention, as shown in the figures, the end portion 12 of the stem 11 may have a substantially axial hollow housing 17 formed in the proximity of the lower contact surface 14.

The hollow housing 17 may have an open bottom to receive the intermediate element 16 and allow the latter to abut against the contact surface 15 of the bottom wall 5.

Particularly, the hollow housing 17 may be formed of such a size as to sealably hold the intermediate element 16, to lock rotation thereof and limit friction with the contact surface 15, without hindering the motion of the stem 11 on the bottom wall 5.

Preferably, the upper contact surface 15 may be formed with an upward convexity of predetermined radius, for instance of spherical shape.

On the other hand, the lower contact surface 14 of the stem 11 may be substantially concave, with a radius substantially corresponding to that of the convex upper contact surface 15.

Thus, the contact surfaces 14, 15 may mate against each other to facilitate the rotary motion of the stem 11, which may be a precession w1 of the second axis X about the first axis L, and a rotation w2 of the stem 11 about the second axis X.

It shall be nevertheless understood that the two contact surfaces 14, 15 may have a reverse configuration with respect to that of the figures, i.e. with a convex lower surface 14 and a concave upper surface 15.

Advantageously, the bottom wall 5 of the tubular body 4 may have a concave central portion 18 housing a first ball 19 whose outer surface defines the convex upper contact surface 15.

The first ball 19 may be freely housed in the concave portion 18 and be susceptible to freely rotate about its center upon interaction with the contact surface 14 of the stem 11.

Nevertheless, in a particularly advantageous embodiment of the invention, the ball 19 may be constrained within the concave portion 18 of the bottom wall 5 to minimize friction wear of the contact surfaces 14, 15.

Also, the intermediate contact element 16 may be a second ball having a maximum diameter $\phi_2$ smaller than the diameter ($\phi_1$ of the first ball 19.

The hollow housing 17 for the intermediate element 16 may be formed in a substantially central area of the upper contact surface 14.

Therefore, the intermediate element 16 and the ball 19 may be constantly aligned along the second axis X and in mutual contact at respective local areas, through which the second longitudinal axis X extends.

Advantageously, the intermediate element 16 and the first ball 19 may be made from a metal, ceramic, composite or other material, having relatively high hardness and wear resistance.

With this particular configuration, very little friction will exist between the two balls 16, 19, and the intermediate element 16 will be substantially unaffected by wear, while the complex precessional $\omega_1$ and rotary $\omega_2$ motion of the stem 11 will not be restricted.

However, the frame 2, the hollow tubular body 4 and the deflecting member 9, or its stem 11 only, may be made of plastic, to reduce the costs of the device 1.

In a further aspect of the invention, axial holding means 20 may be provided, for axially retaining the stem 11 relative to the bottom wall 5 and prevent any excessive upward stroke of the stem 5, thereby avoiding any misalignment of the deflecting member 9.

The axial holding means 20 may be formed at the bottom wall 5 of the lower tubular body 4, and at the periphery of the contact surfaces 14, 15.

Furthermore, the holding means 20 may include a substantially axial retainer element 21, upwardly projecting from the bottom wall 5 and having a radial annular edge 22.

In the configuration of the figures, the retainer element 21 is composed of three distinct elements, only two of which are shown, which are substantially similar and angularly spaced from each other, each having a respective radial edge 22.

At its end portion 12, the stem 11 may have a substantially peripheral radial swelling edge 24, which is designed to interact with the radial annular edges 22 to prevent or limit the displacements of the stem 11 along the first longitudinal axis L and/or the second longitudinal axis X.

The above disclosure clearly shows that the invention fulfills the intended objects and particularly meets the requirement of providing a liquid diffuser device that maintains the diffuser element in its proper position even after long use, thereby ensuring liquid diffusion efficiency.

Due to the particular configuration of the tubular body and the holding means, the coupling portion of the stem will be protected from the ingress of foreign matter and impurities which might jam or hinder its motion.

Therefore, the device will be able to withstand particularly dusty and contaminating environments and have a regular operation therein.

The device of this invention is susceptible to a number of changes and variants, within the inventive concept disclosed in the appended claims. All the details thereof may be replaced by other technically equivalent parts, and the materials may vary depending on different needs, without departure from the scope of the invention.

While the device has been described with particular reference to the accompanying figures, the numerals referred to in the disclosure and claims are only used for the sake of a better intelligibility of the invention and shall not be intended to limit the claimed scope in any manner.

What is claimed is:

1. A liquid diffuser device, comprising:

a support frame having an upper passageway configured to direct a liquid jet and a lower hollow tubular body defining a first longitudinal axis and provided with a substantially transverse bottom wall;

a liquid jet deflecting member having an upper plate located at a predetermined distance from said upper passageway and fixed to a lower stem, said stem defining a second longitudinal axis and being housed into said tubular body; and means for movably coupling said stem to said bottom wall, comprising a lower contact surface of said stem and an upper contact surface of said bottom wall, said contact surfaces being in mechanical communication such to allow rotation of said stem relative to said bottom wall and oscillation of said second axis relative to said first axis responsive to an action of the liquid jet on said plate, wherein said means for removably coupling further comprise an intermediate contact member secured a lower end portion of said stem, said intermediate contact member being configured to continuously contact said upper contact surface of said bottom wall to avoid downward shifting of said stem consequent to wear of said contact surfaces and to keep the distance of said plate from said passageway substantially unchanged, wherein said lower end portion of said stem has a hollow seat downwardly open to provide a housing for said intermediate contact member, wherein said intermediate contact member is stably encased into said hollow seat, wherein said lower contact surface of said tubular body is substantially convex with a predetermined radius of curvature, wherein said bottom wall of said tubular body has a central concave portion housing a first sphere, said first sphere being secured into said concave portion and having an external surface contacting said upper contact surface of said bottom wall, and wherein said intermediate member and said first sphere are aligned along said second axis and in mutual contact relationship at their respective localized areas crossed by said second axis.

2. The liquid diffuser device as claimed in claim 1, wherein said intermediate member is a second sphere with a maximum diameter less than a diameter of said first sphere.

3. The liquid diffuser device as claimed in claim 1, further comprising axial holding means of said stem with respect to said bottom wall to prevent axial separation of said stem from said bottom wall.

4. The liquid diffuser device as claimed in claim 3, wherein said axial holding means comprise at least one radial edge of said lower end portion of said stem with a predetermined external diameter inserted into a substantially tubular and axial holding member solid with said bottom wall and having an annular radial edge with an internal minimum diameter smaller than said external diameter of said radial edge.

* * * * *